US010646738B2

(12) United States Patent
Arturo et al.

(10) Patent No.: US 10,646,738 B2
(45) Date of Patent: May 12, 2020

(54) MODULAR STRUCTURE FOR PHYSICAL EXERCISE

(71) Applicants: Estrada Estrada Carlos Arturo, Bogotá (CO); Castro Clavijo Inés Stella, Bogotá (CO)

(72) Inventors: Estrada Estrada Carlos Arturo, Bogotá (CO); Castro Clavijo Inés Stella, Bogotá (CO)

( * ) Notice: Subject to any disclaimer, the term of this patent is extended or adjusted under 35 U.S.C. 154(b) by 91 days.

(21) Appl. No.: 15/770,609

(22) PCT Filed: Oct. 27, 2016

(86) PCT No.: PCT/IB2016/056484
§ 371 (c)(1),
(2) Date: Apr. 24, 2018

(87) PCT Pub. No.: WO2017/072702
PCT Pub. Date: May 4, 2017

(65) Prior Publication Data

US 2018/0311523 A1 Nov. 1, 2018

(30) Foreign Application Priority Data

Oct. 28, 2015 (CO) ..... 15256716

(51) Int. Cl.
*A63B 21/055* (2006.01)
*A63B 21/16* (2006.01)
(Continued)

(52) U.S. Cl.
CPC ..... *A63B 21/0557* (2013.01); *A63B 21/0442* (2013.01); *A63B 21/0626* (2015.10);
(Continued)

(58) Field of Classification Search
CPC ..... A63B 21/00058; A63B 21/00061; A63B 21/00065; A63B 21/00069; A63B 21/00072; A63B 21/00076; A63B 21/00185; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/062; A63B 21/0622; A63B 21/0624; A63B 21/0626; A63B 21/0628; A63B 21/063; A63B 21/0632; A63B 21/068; A63B 21/08; A63B 21/15; A63B 21/151;
(Continued)

(56) References Cited

U.S. PATENT DOCUMENTS 3,115,339 A * 12/1963 Forte ..... A63B 21/06 482/139
5,403,257 A * 4/1995 Lehtonen ..... A63B 21/023 482/112

(Continued)

*Primary Examiner* — Gary D Urbiel Goldner
(74) *Attorney, Agent, or Firm* — Boyle Fredrickson, SC

(57) ABSTRACT

A modular structure for performing physical exercises incorporates a gripping system that slides along a surface of the modular structure. The gripping system allows for varying height of an anchoring point where different types of resistance bands or ropes are attached. The modular structure is adaptable, easy to use, and has plurality of exercise stations that can be used simultaneously.

18 Claims, 10 Drawing Sheets

(51) Int. Cl.

| | |
|---|---|
| ***A63B 21/04*** | (2006.01) |
| ***A63B 23/035*** | (2006.01) |
| ***A63B 21/00*** | (2006.01) |
| ***A63B 21/062*** | (2006.01) |
| ***A63B 21/02*** | (2006.01) |

(52) U.S. Cl.
CPC ..... *A63B 21/156* (2013.01); *A63B 21/16* (2013.01); *A63B 21/4035* (2015.10); *A63B 23/03541* (2013.01); *A63B 21/00061* (2013.01); *A63B 21/023* (2013.01); *A63B 21/055* (2013.01); *A63B 2225/09* (2013.01); *A63B 2225/093* (2013.01); *A63B 2225/107* (2013.01)

(58) Field of Classification Search
CPC ... A63B 21/152; A63B 21/154; A63B 21/156; A63B 21/159; A63B 21/16; A63B 21/1618; A63B 21/1627; A63B 21/1645; A63B 21/1654; A63B 21/1663; A63B 21/1681; A63B 21/169; A63B 21/4027; A63B 21/4033; A63B 21/4035; A63B 21/4041; A63B 21/4045; A63B 21/4047; A63B 21/4049; A63B 23/035; A63B 23/03508; A63B 23/03516; A63B 23/03533; A63B 23/03541; A63B 23/12; A63B 2225/09; A63B 2225/093; A63B 2225/10; A63B 2225/105; A63B 2225/107
See application file for complete search history.

(56) References Cited

U.S. PATENT DOCUMENTS 5,997,448 A * 12/1999 Duba ..... A63B 21/0552 482/121
6,267,711 B1 * 7/2001 Hinds ..... A63B 1/00 482/121
6,527,683 B2 * 3/2003 Tolles ..... A63B 21/152 482/103
7,553,264 B2 * 6/2009 Carter ..... A63B 21/154 482/102
8,172,733 B1 * 5/2012 Batca ..... A63B 21/156 482/93
8,834,328 B1 * 9/2014 Batca ..... A63B 21/00043 482/100
9,067,100 B2 * 6/2015 Habing ..... A63B 21/156
10,286,279 B2 * 5/2019 Wehrell ..... A63B 21/04
2002/0107116 A1 * 8/2002 Schulz ..... A63B 23/1245 482/97
2002/0119869 A1 * 8/2002 Whited Lake ..... A63B 21/154 482/93
2003/0060345 A1 * 3/2003 Piane, Jr. ..... A63B 21/154 482/100
2006/0040799 A1 * 2/2006 Pompile ..... A63B 21/0552 482/92
2006/0199706 A1 * 9/2006 Wehrell ..... A61H 1/0229 482/92
2006/0252614 A1 * 11/2006 Rotondale ..... A63B 23/1254 482/100
2006/0264305 A1 * 11/2006 Klassen ..... A63B 21/154 482/99
2007/0054785 A1 * 3/2007 Drechsler ..... A63B 21/078 482/94
2007/0161472 A1 * 7/2007 Drechsler ..... A63B 15/00 482/100
2012/0065035 A1 * 3/2012 Makula ..... A63B 21/0552 482/129
2012/0094804 A1 * 4/2012 Bell ..... A63B 21/00069 482/8
2012/0142503 A1 * 6/2012 Sevadjian ..... A63B 21/0442 482/99
2013/0035220 A1 * 2/2013 Adams ..... A63B 21/04 482/129
2013/0130866 A1 * 5/2013 Wehrell ..... A61H 1/0229 482/5
2013/0196832 A1 * 8/2013 Adams ..... A63B 21/04 482/129
2013/0274075 A1 * 10/2013 Habing ..... A63B 21/062 482/102
2014/0038777 A1 * 2/2014 Bird ..... A63B 21/0058 482/5
2014/0121071 A1 * 5/2014 Strom ..... A63B 21/062 482/99
2015/0087486 A1 * 3/2015 Franks ..... A63B 21/0442 482/129
2015/0165272 A1 * 6/2015 Bird ..... A63B 21/0058 482/5
2016/0121156 A1 * 5/2016 Bach ..... A63B 21/0087 482/112
2016/0151656 A1 * 6/2016 Vannicatte ..... A63B 21/0058 482/4

* cited by examiner

MODULAR STRUCTURE FOR PHYSICAL EXERCISE

CROSS-REFERENCE TO RELATED APPLICATIONS

This application is a national phase application under 35 U.S.C. 371, claiming priority to PCT Application No. PCT/IB2016/056484, filed Oct. 27, 2016 and titled Modular Structure for Physical Exercise, which, in turn, claims priority to Columbian Application No. CO 15256716, filed Oct. 28, 2015, the entire contents of each application is incorporated herein by reference.

FIELD OF THE INVENTION

This invention generally relates to equipment or apparatuses for performing physical exercise and, particularly it relates to a sliding gripping system placed on top of a surface and to a modular structure that contains said system, configured to perform any kind of exercise that uses ropes or bands, either rigid or elastic, which can be applied to the fields of occupational health, physiotherapy and physical training in general.

BACKGROUND OF THE INVENTION

There currently exists a number of apparatuses designed for use with rigid and elastic bands and similar equipment that allow for performing exercises for strengthening different parts of the body.

As a reference, the following related patents were found:

Patent Application with publication number US20110237410A1, filed by CORE ENERGY FITNESS LLC on Mar. 22, 2011:

This patent application entitled "Resistance Band Exercise Station" consists of a modular hooking system that allows performing different exercises using different types of exercise tools requiring anchorage. This invention utilizes multiple units of safety hooks consisting of open-loop hooks having a barrier member such as a T-bar at the tip to prevent the straps from slipping out.

U.S. Pat. No. 6,267,711B1 filed by Robert Sylvester on Jul. 31, 2001: This patent entitled, "Elastic cord exercise assembly" consists of an assembly that can be mounted upon the face of a door or wall surface. This machine consists of two guide rails that allow movement to adjust the height of the cord assembly; it also has two cross bars that cover a wide range of exercises by means of an exercise elastic rope.

Patent Application with publication number US2013/0324378A1 filed by LIMITLESS WELLNESS PROJECT LLC, on Dec. 5, 2013:

This patent application entitled, "Removably Mounted Exercise Station" consists of an anchorage member with a plurality of apertures on the front surface, forming rails used to anchor the straps. The band uses a clamp attached to the resistance line made of rubber or plastic, on one side, and one handle on the opposite end. The station can be mounted on trees and other fixed objects using straps. Additionally, the station can be fixed to a wall using screws.

U.S. Pat. No. 6,908,418B2 filed by Paul Saure on Jun. 25, 2005:

This patent entitled, "Door mounted deadman for exercise devices" consists of a continuous strap that extends vertically in the same direction of the door. The equipment is secured by means of a ladder lock that fits the door and D-rings joined at different heights, where users can attach the elastic bands.

U.S. Pat. No. 5,626,546 filed by James R. Little on May 6, 2007:

This patent entitled, "Wall-mounted exercise Unit" is another wall mount system that uses two rails with a supporting bracket. This unit allows for multiple exercises, including elbow flexion using a bar, thanks to a cross bar included. This unit has a number of hooks used to connect different adaptors and elastic devices.

Similarly, there is equipment available on the market such as the "Slide Exercise Rail Wall" produced by ISOKINETICS, Inc. This equipment consists of a rail with multiple slots at various heights where resistance bands can be attached. ISOKINETICS, Inc. equipment has been designed exclusively for use with resistance bands which are also manufactured by ISOKINETICS, Inc. Additionally, this structure requires more time than other products available on the market when it comes to move the band to a different height or to change band resistance.

There are other commercial products available such as the "TheraBand Wall Station" and the "TheraBand Rehab and Wellness Station" produced by the company THERABAND, which consist of three rails: two of them are vertically aligned and the third one—a shorter one—is horizontally placed in the middle, allowing for multiple exercises. Both exercise stations require the use of resistance bands which are also made by the company THERABAND.

However, all of the above-mentioned exercise structures or systems designed for use with bands or ropes, either elastic or rigid, have some flaws.

Specifically, the use of the above-mentioned devices and other systems available on the market require a supporting structure, which forces the sporting goods consumer to resort to another object to perform specific exercises, thus causing wear in the object, as well as in the rope or band; besides, as the exercise system is fixed to a third structure, it is rarely placed at the height appropriate to each user.

On the other hand, major consumers of this kind of exercise equipment include gyms and sport centers, which must cater for a considerable large amount of customers, with different exercise requirements, simultaneously; this causes wear in elastic bands or ropes due to the flow of users; furthermore, provided these devices have their own individual supporting structures, they only allow for a few users to exercise at the same time, and therefore no training circuits of muscle groups can be performed by several users simultaneously.

As far as the sportsmen market is concerned, the use of elastic bands and ropes becomes important because they reduce the impact and offer the possibility to perform a wider range of exercises in areas of difficult access or under particular conditions where training is performed (i.e. swimming pools and soccer fields). In some training facilities, supporting structures available on the market cannot be adjusted and sportsmen are forced to resort to any object at hand in order to attach the bands to said objects. This poses a risk since not every object is suitable to bear the force applied; furthermore, continuous friction causes bands to wear rapidly or even put users at risk in case a band disengages from its support structure.

Additionally, exercise products currently available on the market are neither space-efficient nor comfortable, when training with elastic or rigid bands. Particularly, equipment currently available is for individual use; therefore, one device is required for each user which implies higher costs and larger space requirements, especially when users are performing maximum extension exercises such as shoulder blade adduction.

Most of the documents of the prior art reviewed, present equipment which include a straight support which is fully in contact with the surface it is attached to, and it does not accept being attached to a surface having any irregularity or protuberance.

After identifying the above-mentioned problems and deficiencies in state-of-the-art exercise equipment, the modular structure for physical exercise disclosed in this document was developed; it consists of a training station for ropes and resistance bands that substantially eliminates the issues arising from the limitations and disadvantages of the prior art.

BRIEF DESCRIPTION OF THE INVENTION

The present invention consists of a sliding gripping system placed on top of a surface and a modular structure for physical exercise which includes said sliding gripping system. The modular structure for physical exercise is characterized in that it is possible to have multiple work places, which can be used simultaneously, and a sliding gripping system which allows for varying the height of the anchor points to which ropes of bands are attached when performing the exercise.

This invention allows the use of different types of ropes or bands, either elastic or rigid.

A subject matter of the present invention is providing a flexible easy-to-use exercise station with resistance bands that can accommodate different types of resistance bands and other exercise accessories that require anchoring to a physical object.

The present invention is aimed at solving the following problems found in equipment currently available on the market:

1. Products available on the market do not make adequate use of space and are not comfortable when performing exercises involving the use of elastic or rigid bands.

2. Products currently available have been designed for individual use only, which demands larger space for the exercise machine in addition to the space required by each user to perform the applicable exercise, which consequently entails higher occupied-area related costs.

3. Exercise machines currently available do not allow for each user to adjust the height of the supporting structure according to their personal condition and such deficiency may constitute a fundamental factor for risk injury when performing any sport, training, stretching activity, exercise, etc.

The modular structure for physical exercise disclosed in the present invention offers the following advantages:

1. Easy, rapid and safe sliding of the sliding gripping system.

2. Ease to work simultaneously with other users.

3. Ease to perform any exercise using elastic or rigid bands.

In order to have a better understanding of the features and advantages of the present invention, it is necessary to set forth the following description and claims together with the attached drawings in which its elements or parts are described using conventions, as follows:

LIST OF PIECES OF THE INVENTION

Modular structure for physical exercise (10)
Upper base of structure (11)
Upper base screws (17)
Upper base nuts (79)
Upper base joints (18)
Lower base of structure (12)
Plate A of lower base (13)
Plate B of lower base (14)
Lower base screws (15)
Lower base nuts (16)
Lower base joints (78)
Anchoring orifices (55)
Sliding surface (200)
Handrails (19)
Handrail joints (20)
Handrail screw (21)
Handrail nut (22)
Sliding surface rail (23)
Sliding surface tube (24)
Large lower pulley screw (25)
Large upper pulley screw (77)
Gripping means (300)
Hook (26)
Large section (27)
Gate (28)
Swivel joint (29)
Small opening of swivel joint (30)
Large opening of swivel joint (31)
Swivel joint screw (32)
Swivel joint nut (33)
Disk (34)
Disk nut (36)
Spring (35)
Protector plate (37)
Protector plate handles (38)
Protector plate casters (39)
Dowels (40)
Protector plate screws (41)
Protector plate nuts (42) (not illustrated)
Foam rubber (43)
Caster (44)
Main spring (45)
First wire rope (6)
Second wire rope (47)
Upper square tube clip (48)
Lower square tube clip (82)
Upper rail clip (83)
Lower rail clip (84)
Lower nipple (49)
Upper nipple (85)
Large lower pulley (50)
Large upper pulley (80)
Lower bushing (51)
Small lower pulley (52)
Small upper pulley (81)
Upper bushing (76)
Upper hook or snap hook (53)
Lower hook or snap hook (86)
Counterweight (54)
Band or rope (75)

LIST OF DRAWINGS OF THE INVENTION

DETAILED DESCRIPTION OF THE INVENTION

Figure 1:
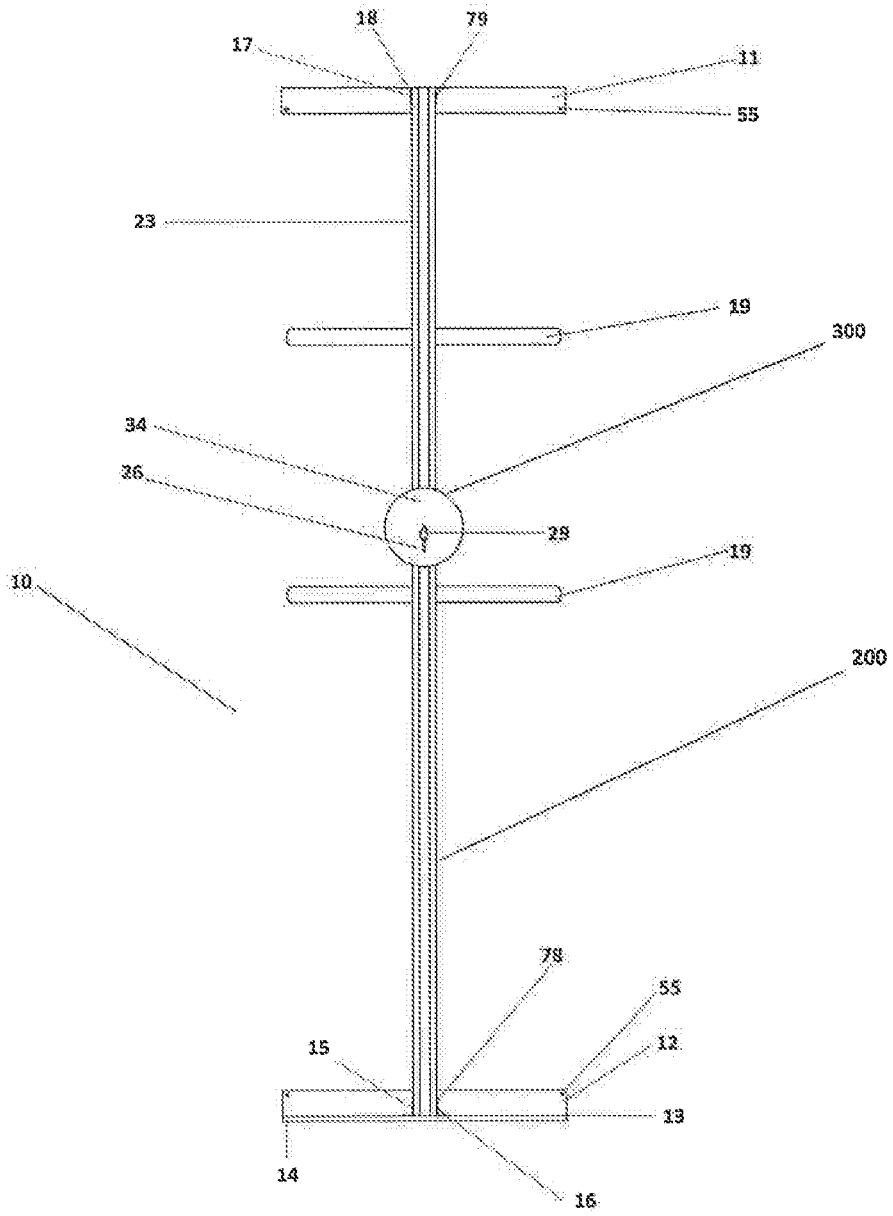
FIG. 1 is a front view of the modular structure for physical exercise (10), according to the invention.

The present invention relates to a gripping system that slides on a surface that comprises:

a. Gripping means (300); and b. Sliding surface (200) for the gripping means (300).

The gripping means (300) are composed mainly of:

a. a hook (26);

b. a swivel joint (29);

c. a swivel joint nut (33);

d. a caster (44);

e. a main spring (45); and f. a swivel joint screw (32).

The sliding surface (200) on which the gripping means (300) slide consists of:

a. a sliding surface rail (23);

b. a sliding surface tube (24);

c. a first wire rope (46);

d. a second wire rope (47);

e. a large lower pulley (50);

f. a large upper pulley (50);

g. a small lower pulley (52);

h. a small upper pulley (81); and i. a counterweight (54).

Another embodiment of the present invention presents a modular structure for physical exercise (10) which incorporates the sliding gripping system of the invention.

In reference to FIG. 1, the modular structure for physical exercise (10) which incorporates the sliding gripping system of the invention consists of:

a. an upper base of structure (11);

b. a lower base of structure (12);

c. gripping means (300); and d. a sliding surface (200) of the gripping means (300).

The upper base of the structure (11) is a plate that allows for fixing the sliding surface (200) and its function is allowing the anchoring of the modular structure for physical exercise (10) to a surface of any plane.

The lower base of the structure (12) is composed of a Plate A of the lower base (13) and a plate B of the lower base (14), which are fixed by means of the lower base screws (15), the lower base nuts (16) and the lower base joints (78). This lower base of the structure (12) has the function of anchoring the modular structure for physical exercise (10) to a surface of any plane.

Both the upper base (11) and the lower base (12)) of the structure have anchor orifices (55) which allow accommodating a wide range of anchors, depending on the resistance desired and the surface to which the structure will be fixed to.

The upper base of the structure (11) also has upper base screws (17) and upper base nuts (79) for anchorage to the supporting devices of the structure.

Bases (11) and (12) of the structure (10) allow for the structure to be installed at a certain height from the floor (anchored to a surface such as a wall) or at floor level, on any surface of any plane or even on irregular surfaces, thus responding to every need of the sporting goods consumers.

The upper bases (11) and lower bases (12) are anchored to a surface, in order to have a rigid structure that is able to support the great forces applied.

Figure 3:
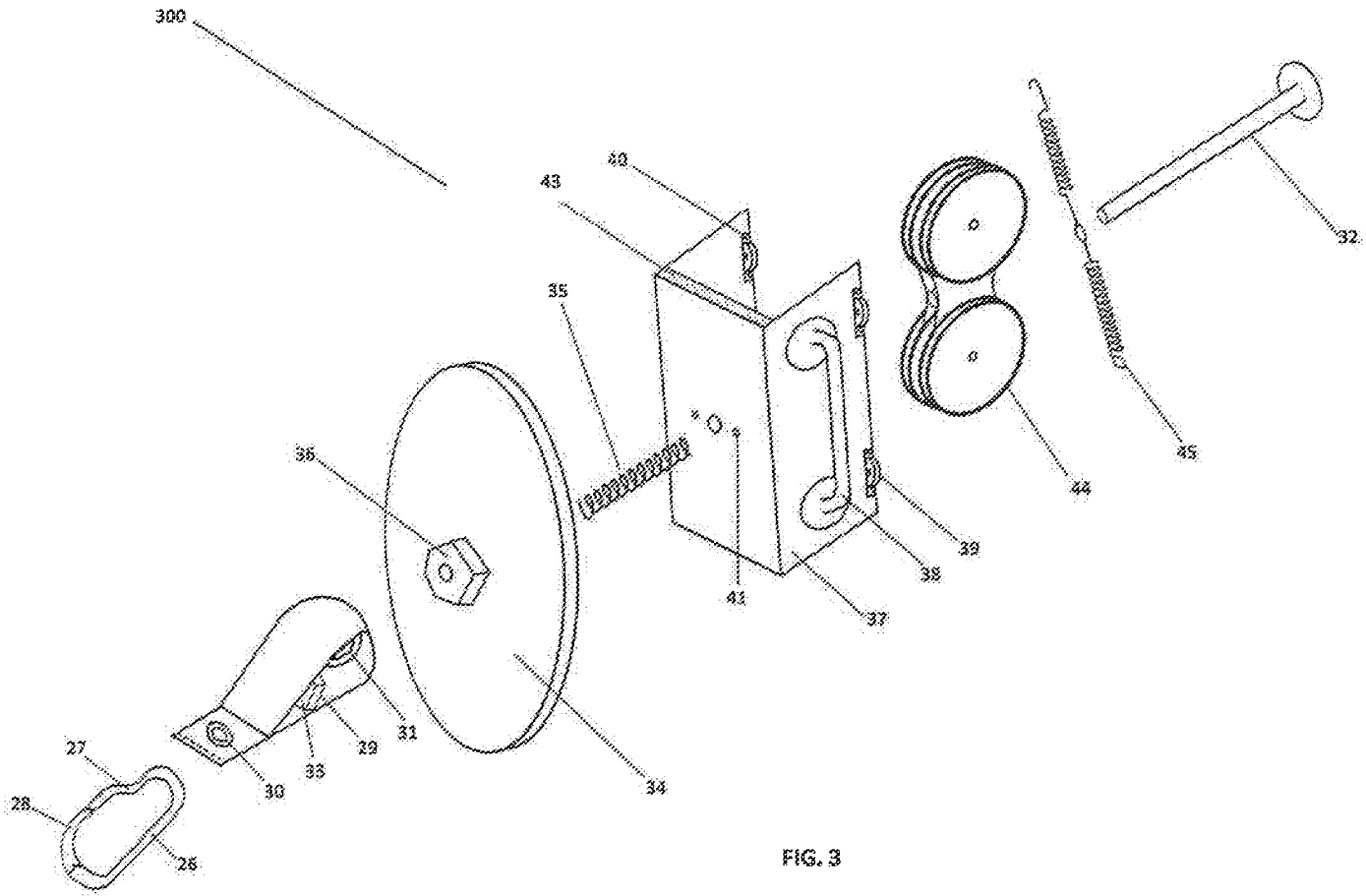
FIG. 3 is an axonometric view of the gripping means (300) along with a list of the applicable parts.

Moving along to FIG. 3, the gripping means (300) consist of the following parts:

a. a hook (26);

b. a swivel joint (29);

c. a swivel joint nut (33);

d. a caster (44);

e. a main spring (45); and f. a swivel joint screw (32).

The gripping means (300) of the modular structure (10) of the present invention also contain two protector plate handles (38), a pulley system (50 and 52) and one counterweight (54), specially designed for a delicate and smooth movement, allowing for a comfortable way to unlock the safety system, pull and slide the gripping means (300), so as to change the gripping position using a simple force applied. Consequently, the modular structure (10) offers efficient adaptability to the characteristics of specific exercises or users.

The hook (26) correspond to a conventional hook having a large section (27) and a gate (28).

This hook (26) can rotate 360 on a vertical plane by means of a swivel joint (29). That is to say, this swivel joint (29) allows for a bird's-eye rotation of the hook (26) so that the rope or band (75) is always in the same position with respect to the hook (26).

The swivel joint (29) correspond to a loop-shaped element manufactured in any high duration fiber having a large opening in the swivel joint (31) and with a small opening in the edge of the swivel joint (30).

Inside the swivel joint (29), in the inside diameter of the loop, a swivel joint nut (33) is placed, which allows fixing the swivel joint (29) to the swivel joint screw (32).

The hook (26) is inserted in the small opening (30) of the swivel joint (29).

This swivel joint (29) allows for the hook (26) to move freely in the direction of the band or rope (75) and also allows for reduced wear since the hook (26) does not allow lateral sliding.

In another embodiment of the invention, the gripping means (300) may also have a disk (34).

The disk (34) corresponds to a piece of circular shape with an orifice in its center wherein a swivel joint screw (32) is fixed using a nut (36).

The disk (34) produces optimal resistance for compressing the spring (35).

The caster (44) correspond to an element that allows for sliding the gripping means (300) smoothly and is located inside the rail of the sliding surface (23).

The main spring (45) is located between the spring (35) and the caster (44), and slides by means of a swivel joint screw (32).

On the ends of the spring (45), the ends of the first wire rope (46) the second wire rope (47) are placed, attached to the upper rail clip (83) and lower rail clip (84)

Finally, the gripping means (300) have a swivel joint screw (32) that allows the coupling of all pieces of the gripping means (300) together provided this screw passes through the following elements: the main spring (45); the caster (44); the protector plate (37); the spring (35); the swivel joint nut (33); the disk nut (36); the large opening of the swivel joint (31).

The gripping means (300) also have a spring (35) and a protector plate (37). The spring (35) slides along the swivel joint screw (32) positioning itself between the disk (34) and the protector plate (37). As mentioned above, the disk (34) produces a resistance that compresses the spring (35).

FIG. 3 also shows the protector plate (37) consisting of two handles (38) that allow for an easily handling of the safety system for sliding the gripping means (300), compressing the spring (35) in the user's direction.

The protector plate (37) also has four casters (39) which allow for a smooth sliding along the sliding surface rail (23).

Protector plate casters (39) are fixed to the protector plate using dowels (40).

Two protector plate screws (41) and two protector plate nuts (42) (not shown) are fixed to the protector plate (37), which serve as a safety system.

Finally, foam rubber (43) is attached to the protector plate (37).

The modular structure for physical exercise (10) contains an improved tension absorber and wear-reduction system based upon the gripping means (300), as shown in FIG. 3. This improved tension absorber and wear-reduction system works based on the fact that the swivel joint (29) allows for the lower hook or snap hook (86) to remain perpendicular or in the same direction of the band/rope (75) tension.

Figure 2:
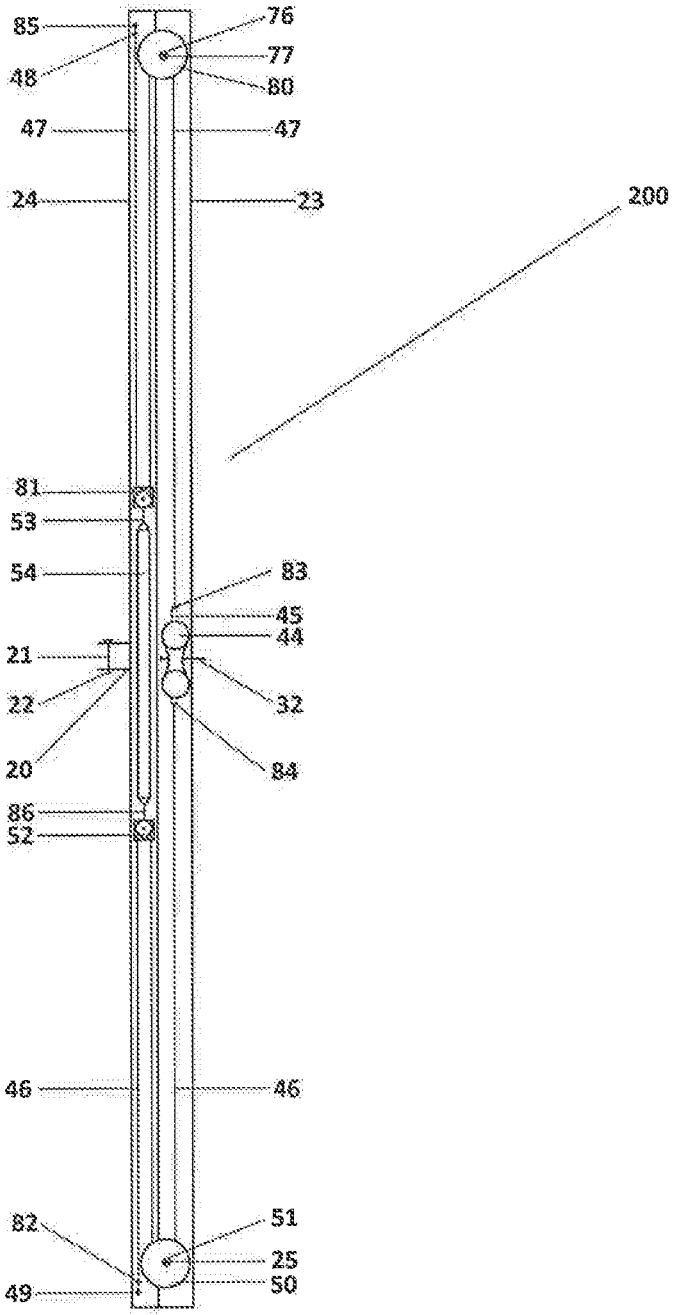
FIG. 2 is an interior view of the sliding surface (200) of the modular structure for physical exercise (10), according to the invention.

Referring now to FIG. 2, it shows an inside view of the sliding surface (200) of the modular structure for physical exercise (10), according to the invention, which consists of:

a. a sliding surface rail (23);
b. a sliding surface tube (24);
c. first wire rope (46);
d. second wire rope (47)
e. large lower pulley (50);
f. large upper pulley (80);
g. small lower pulley (52);
h. small upper pulley (81); and
i. counterweight (54).

The sliding surface rail (23) and the sliding surface tube (24) are fixed, on both ends, to the upper base joints (18) and lower base joints (78). In the preferred embodiment of the invention, the sliding surface rail (23) and the sliding surface tube (24) have a length of 2 meters.

The sliding surface rail (23) is a metal bar on which the gripping means (300) slides.

The sliding surface tube (24) is a metal tube wherein some of the main components of the modular structure for physical exercise (10) are accommodated.

Particularly, this sliding surface tube (24) accommodates: the second wire rope (47); upper hook or snap hook (53); counterweight (54); small lower pulley (52); and first wire rope (46), lower nipple (49), as shown in FIG. 2. Furthermore, this sliding surface tube (24) serves as an anchorage support for the handrails (19) and as structural reinforcement for the sliding surface rail (23).

The first wire rope (46) is manufactured in steel cable helically wound.

The second wire rope (47) has the same characteristics and length of the first wire rope (46).

The first wire rope (46) passes through the large lower pulley (50) located in the large lower pulley screw (25) with a lower bushing (51) and goes through the small lower pulley (52) thus leading the first wire rope (46) towards one of the ends of the main spring (45).

On the opposite end of the first wire rope (46), the lower nipple (49) is placed, located in the sliding surface tube (24), securing it with the lower square tube clip (82).

The second wire rope (47) passes through the large upper pulley (80) located in the large upper pulley screw (77) with an upper bushing (76) and goes through the small upper pulley (81), thus leading the second wire rope (47) towards one of the ends of the main spring (45).

On the opposite end of the second wire rope (47), the upper nipple (85) is placed, located in the sliding surface tube (24), securing it with the upper square tube clip (48).

The end of the small lower pulley (52) attaches the lower hook or snap hook (86), which attaches to the opposite end of the counterweight (54).

Similarly, the small upper pulley (81) attaches to the upper hook or snap hook (53), which attaches to the opposite end of the counterweight (54).

The lower hooks or snap hooks (86), upper hooks (53) and hook (26) are comprised of two parts. The first part is a unit made of an elongated material bent in such a way that both ends are facing each other, but with a distance between them. The second part is another unit, made of the same material of the first unit hereinabove described, fixed to one of the ends of the first part, in such a way that it can be moved, pulling it closer or farther to the opposite end of the first part. This part does not allow the band or rope (75) (shown in FIGS. 6, 7, 8, 9 and 10) to disengage and make it easy to go back to the inside in a smooth and quick manner.

Finally, the counterweight (54) is a cylinder the height of which is larger than the radius of the base; this cylinder is made of any material having a mass enough to offset the weight of the gripping means (300). At the ends of the counterweight (54), it has two rings to hold it with the upper and lower hooks (53) and (86), respectively, and the wire rope system (46) and (47), as shown in FIG. 2. The counterweight (54) is placed within the sliding surface tube (24).

The main part of the safety system of the modular structure for physical exercise (10) are the protector plate screws (41), which matching specific spots of the rail of the sliding surface (23)—orifices with a diameter slightly larger than the diameter of the protector plate screw (41), which allows them to slide along such orifices and perform only the movements voluntarily made by the user.

The exercise station of the present invention contains a practical single-structure/support system accommodating one (1) to three (3) users, located in an optimal point for people to exercise comfortably.

In one embodiment of the present invention, one, two or three sliding surfaces (200) can be installed on the same modular structure (10), in this embodiment of the invention, the two or three sliding surfaces (200) share the same bases (11) and (12) and handrails (19). Each sliding surface (200) may be added to the structure at different moments, in case the sporting goods consumer wishes to increase the capacity of the modular structure (10).

The structure of the present invention allows for adjusting the height of the rope or band (75) to work at the appropriate height for different kinds of exercises of the majority of muscle groups and, at the same time, accommodate for several exercise places.

That is to say, the modular structure for physical exercise (10) allows for several exercise places with an individual gripping and sliding system, at the same time, thus allowing several people to exercise simultaneously, at the same or at a different height of the hook, or one person exercising several muscle groups in a circuit.

One of the greatest advantages of the modular structure for physical exercise (10) of the present invention is the possibility to modify the gripping height and accommodate several exercise places at the same time, which is not currently available.

The modular structure for physical exercise (10) can also have one or more sliding surfaces (200), which allow the sliding system and the counterweight of the gripping means (300) to operate.

The commercial design of the modular structure for physical exercise (10) keeps users or any person from seeing the content or operation of the internal mechanisms, thus avoiding accidents, illegal reproduction and lack of aesthetics.

Figure 4:
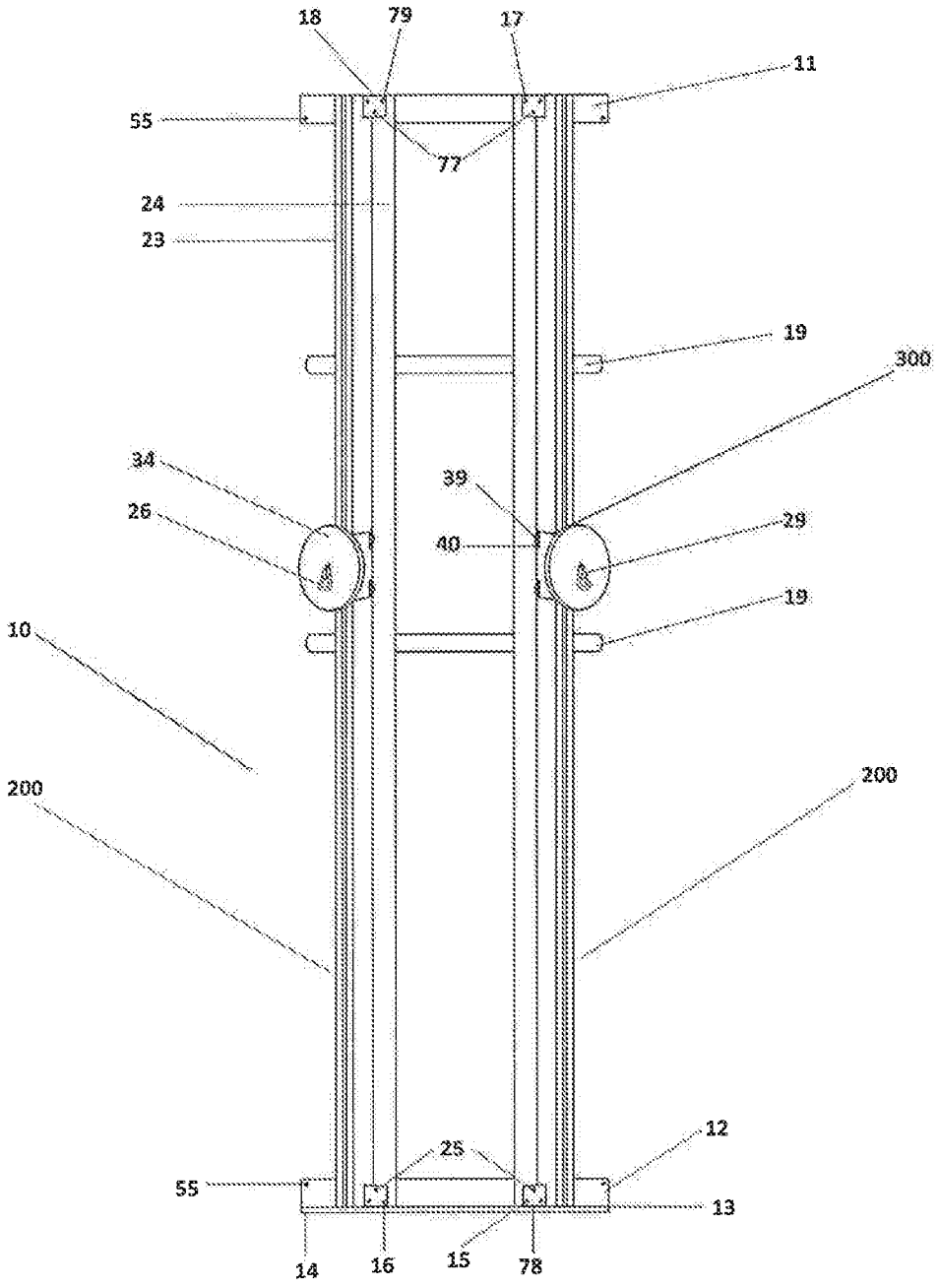
FIG. 4 is a front view of the modular structure for physical exercise (10), according to the invention, adapted for two users.

FIG. 4 shows a front view of the modular structure for physical exercise (10) according to the invention, adapted for two users. FIG. 4 shows two sliding surfaces (200) with the gripping means (300) positioned at a different height, depending on the specific exercise to be performed by the user.

Figure 5:
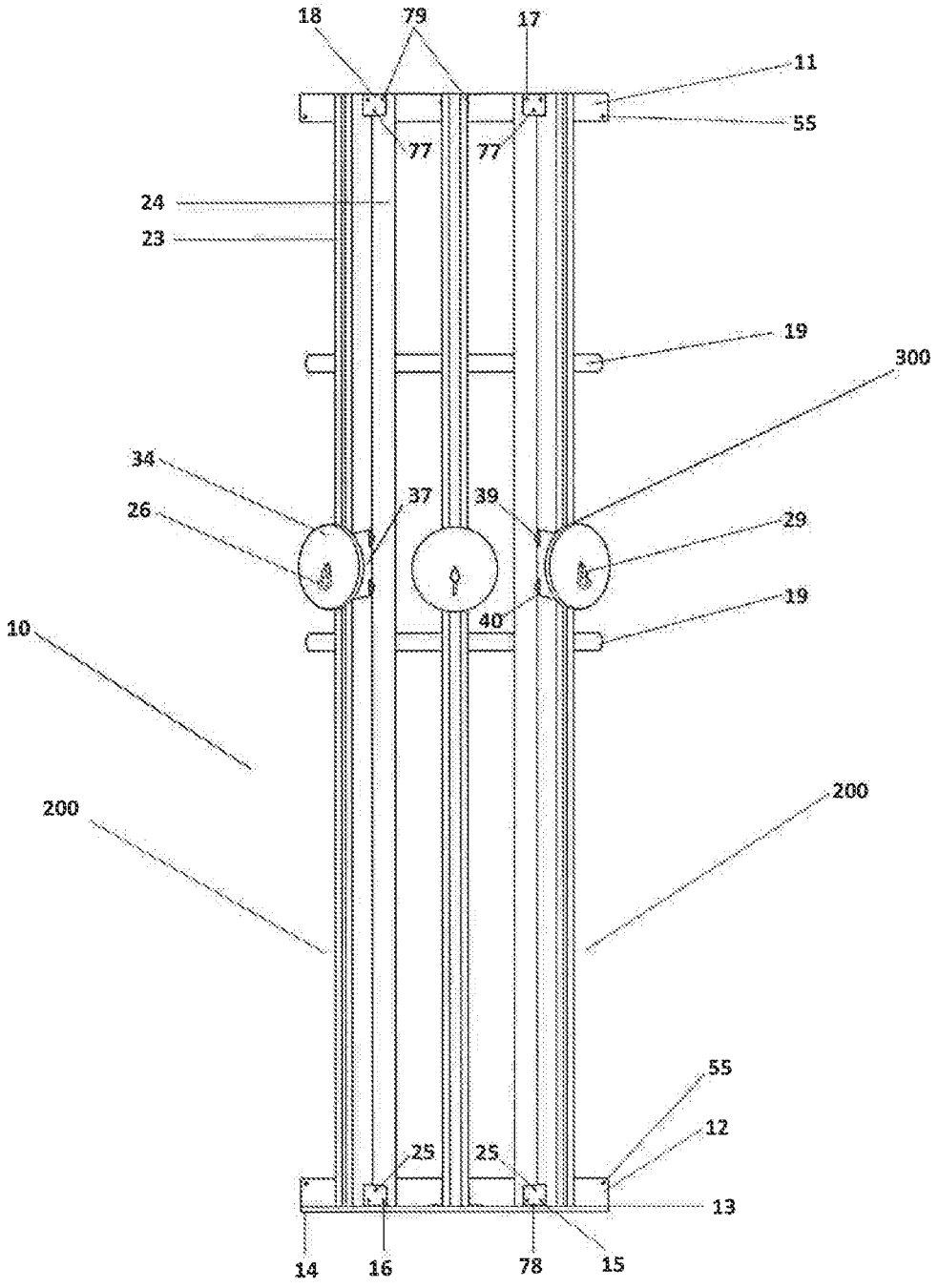
FIG. 5 is a front view of the modular structure for physical exercise (10), according to the invention, adapted for three users.

FIG. 5 shows a front view of the modular structure for physical exercise (10), according to the invention, adapted for three users, showing three sliding surfaces (200) and gripping means (300) at the same height so that three users are able to perform exercises on the modular structure for physical exercise (10) without any interference.

Figure 6:
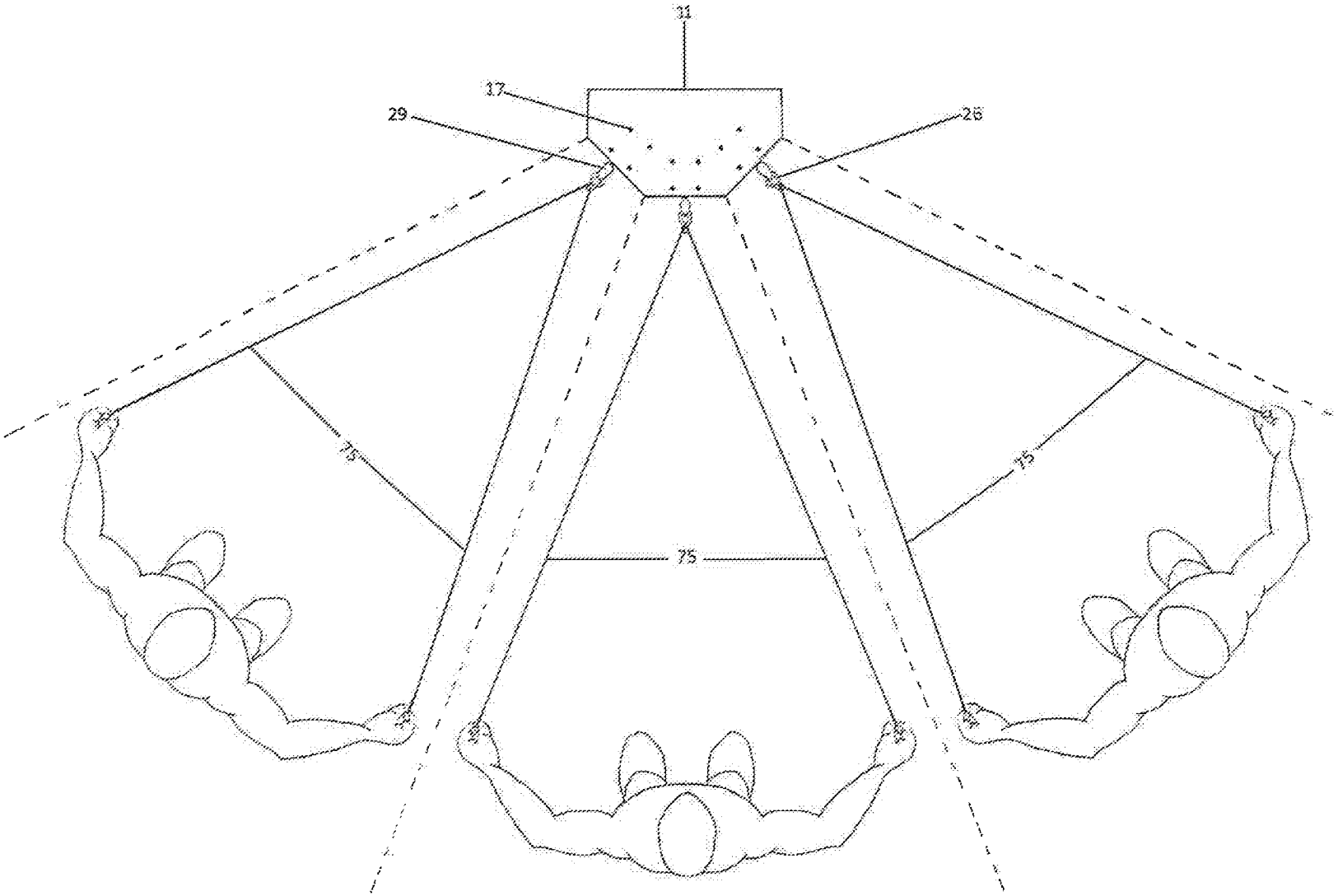
FIG. 6 is a top front view of the modular structure for physical exercise (10), according to the invention, adapted for three users, when performing a maximum extension exercise.

FIG. 6 shows a top view of the modular structure for physical exercise (10), according to the invention, adapted for three users, performing a maximum extension exercise. This Figure shows three possible users performing exercises with hands or ropes (75) at the position of maximum extension.

Figure 7:
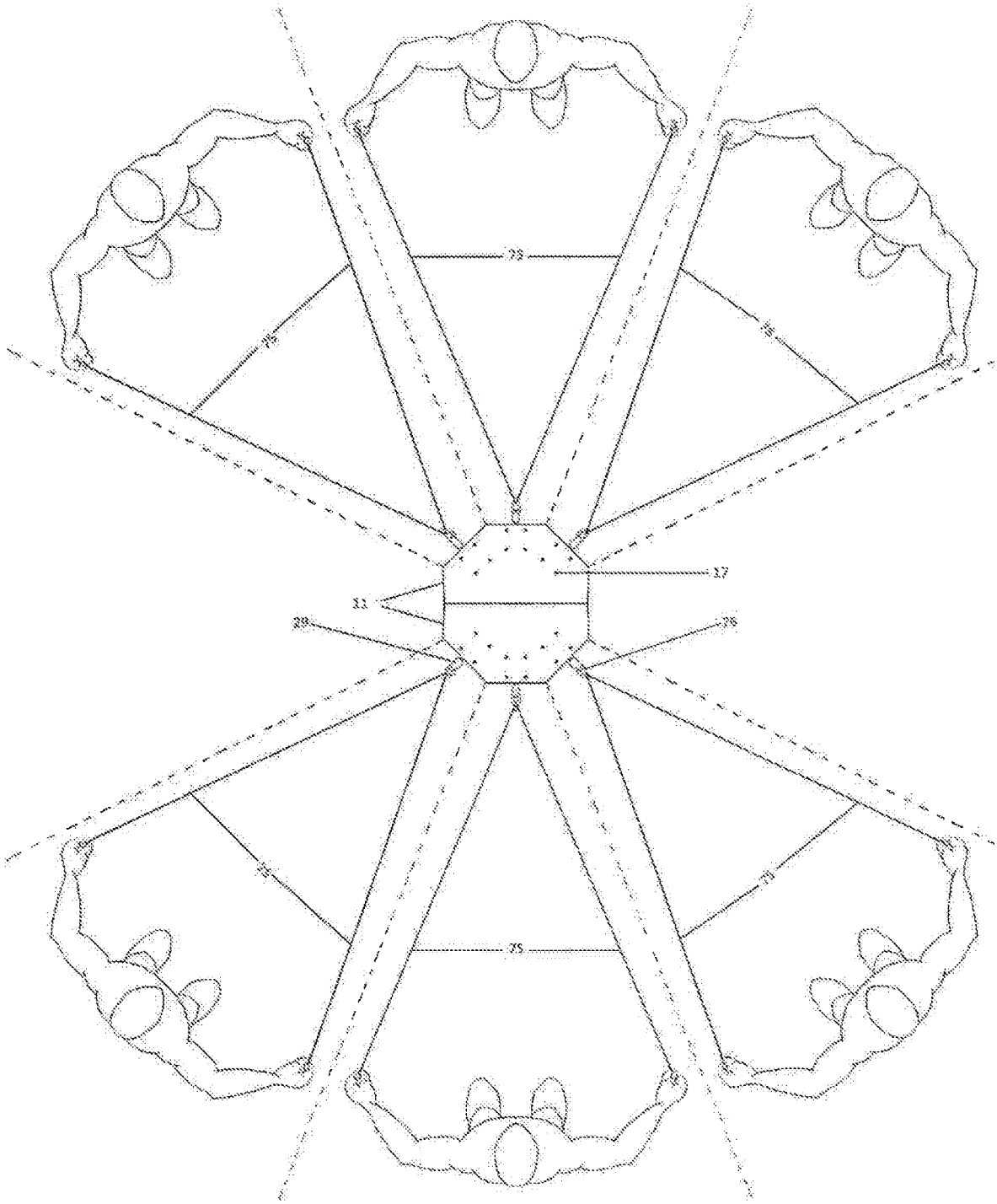
FIG. 7 is a top view of the modular structure for physical exercise (10), according to the invention, adapted for six users, when performing a maximum extension exercise.

On another embodiment of the present invention, two modular structures can be installed, connected through their bases and orifices, replacing the screws (51) of the lower bases with anchorage that provides the structure with the rigidity necessary, as shown in FIG. 7. This Figure shows six possible users performing exercises with bands or ropes (75) in the position of maximum extension.

Figure 8:
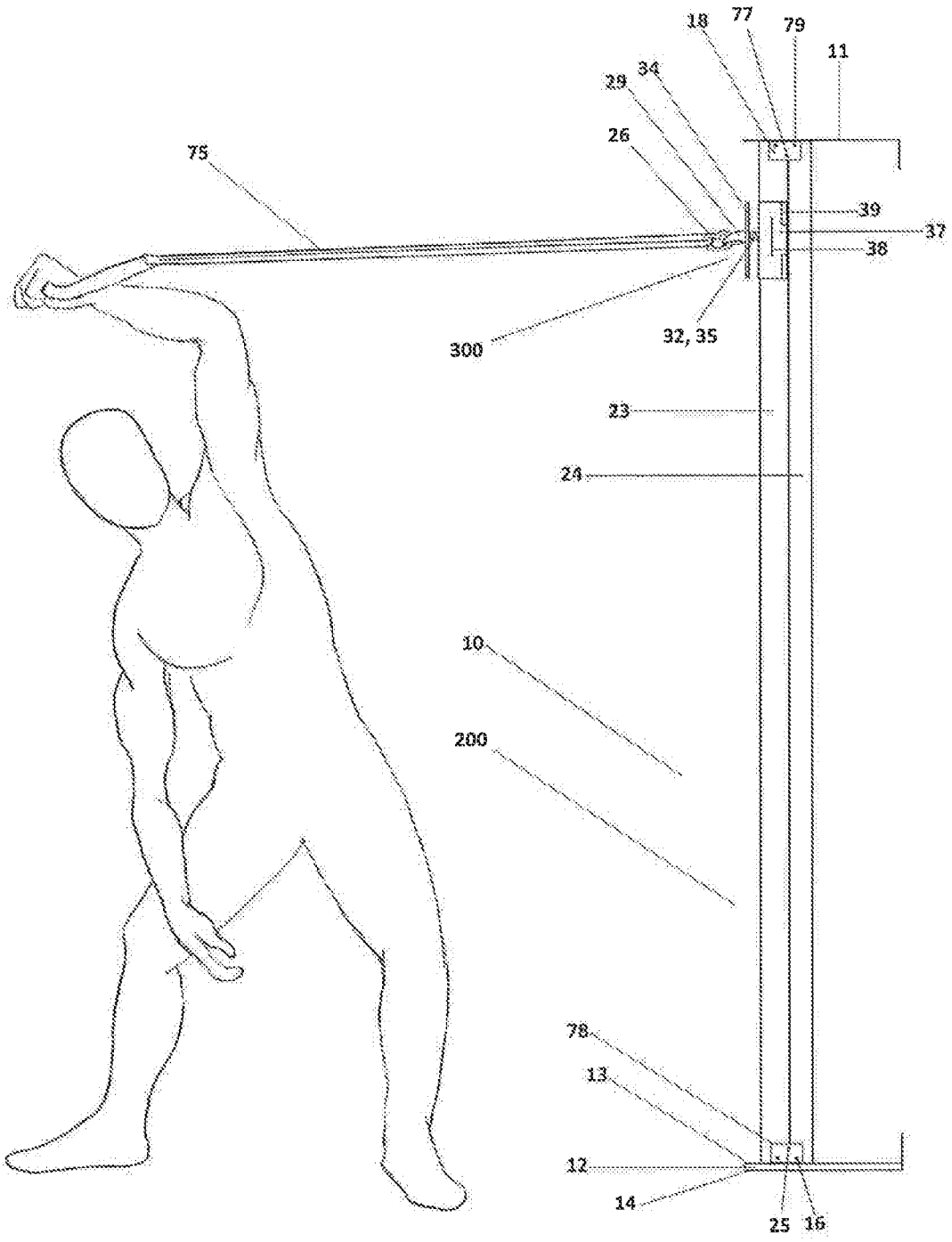
FIG. 8 is a side view of the modular structure for physical exercise (10), according to the invention, adapted for one user, with the gripping system on the upper position.

FIG. 8 is a side view of the modular structure for physical exercise (10), according to the invention, adapted for one user, with the gripping means (300) in the upper position. This Figure shows how the user adapted the gripping means (300) to the highest position on the sliding surface (200).

Figure 9:
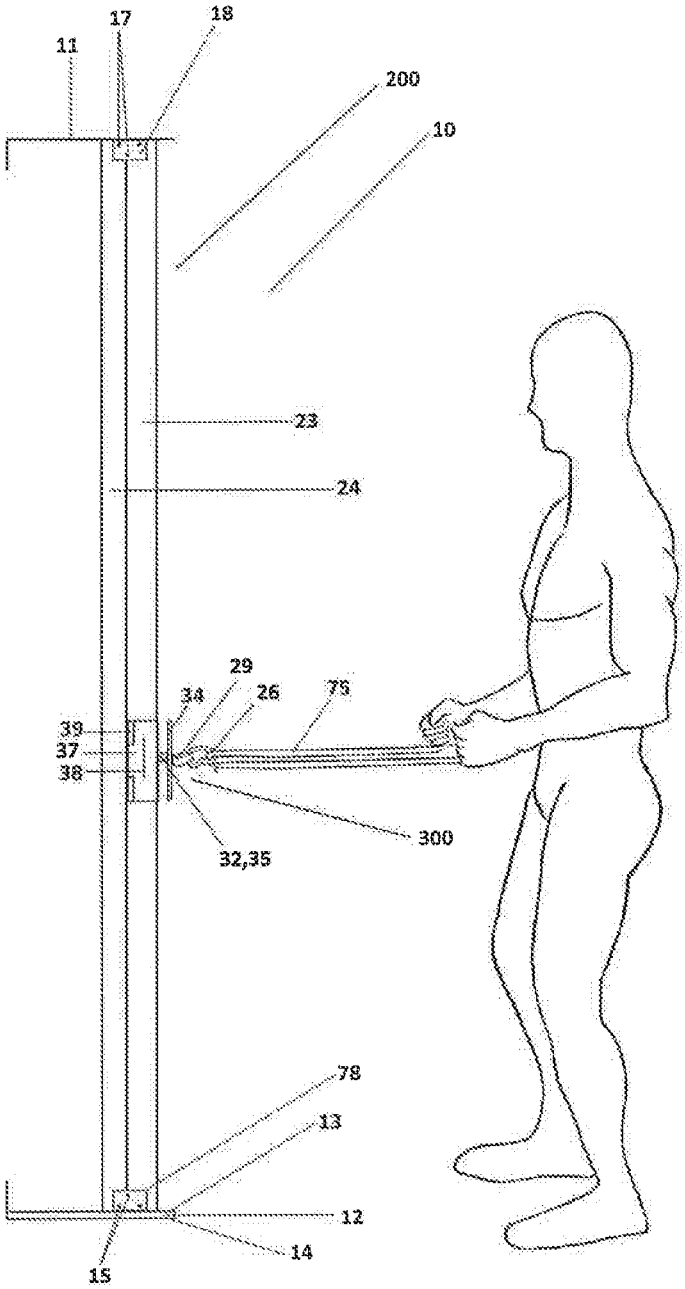
FIG. 9 is a side view of the modular structure for physical exercise (10) according to the invention, adapted for one user, with the gripping system on the middle position.

FIG. 9 is a side view of the modular structure for physical exercise (10), according to the invention, adapted for one user, with the gripping means (300) in the middle position. This Figure shows how the user adapted the gripping means (300) to the middle position on the sliding surface (200).

Figure 10:
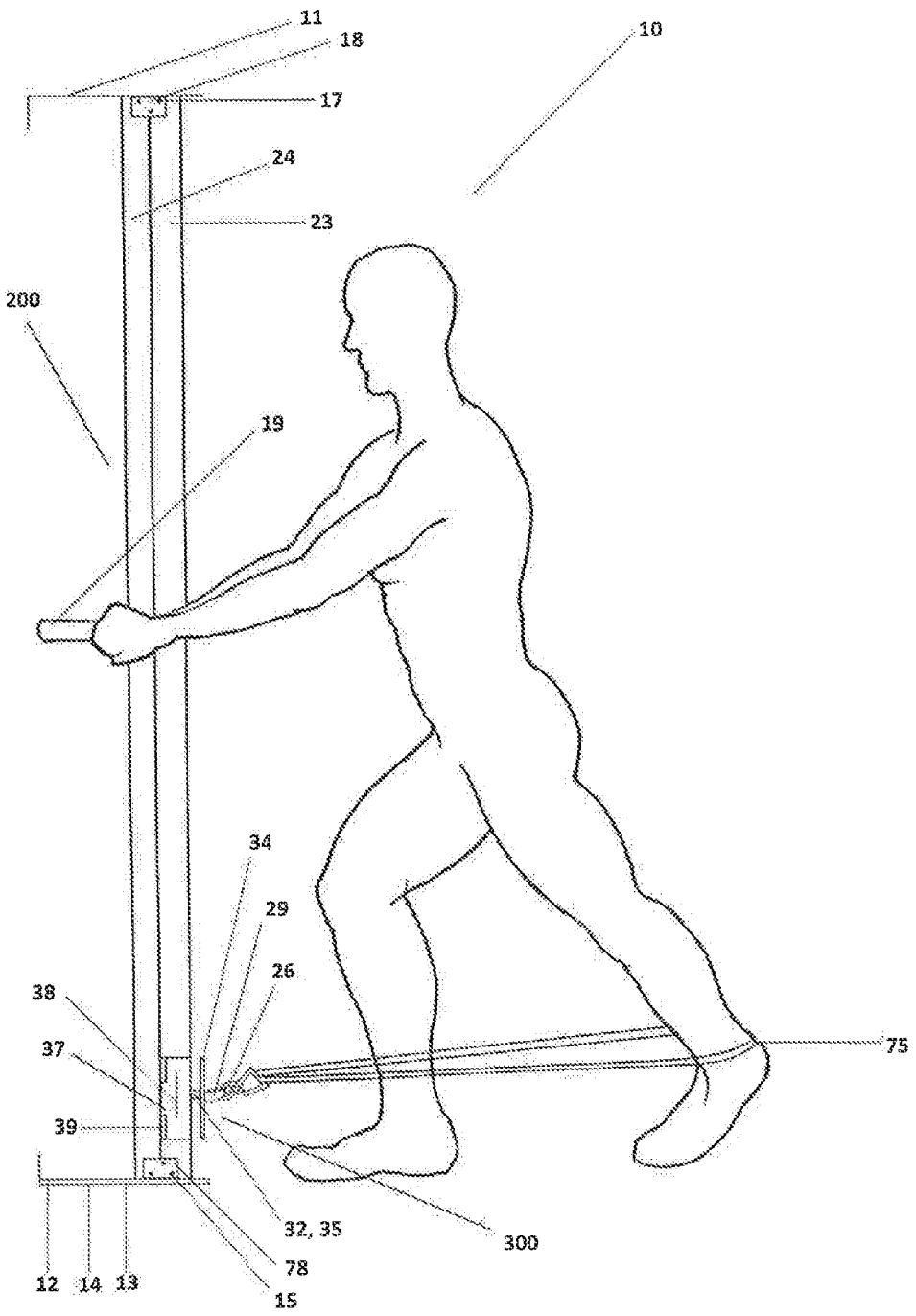
FIG. 10 is a side view of the modular structure for physical exercise (10) according to the invention, adapted for one user, with the gripping system on the lower position.

FIG. 10 is a side view of the modular structure for physical exercise (10), according to the invention, adapted for one user, with the gripping means (300) in the lower position. This Figure shows how the user adapted the gripping means (300) to the lower position on the sliding surface (200).

Similarly, the modular structure for physical exercise (10), has handrails (19) (shown in FIGS. 1, 4 and 5), which attach to each sliding surface (200) by means of the handrail joints (20), a handrail screw (21) and a handrail nut (22), as shown in FIG. 2. The modular structure for physical exercise (10) can have one or more handrails (19), as required. These handrails (19) allow users to lean on and adapt in a safe and comfortably manner the exercises to their particular physical condition or intellectual limitations. Due to its easy to use design, the modular structure of the present invention can be used by people with physical, mental, sensorial or intellectual disabilities.

The present invention is useful for the physical exercise area and may be used by particular users or by gyms that provide individuals with physical exercise services.

The following is a summary of the advantages offered by the modular structure for physical exercise of the present invention:

1. Allows for a plurality of people to perform exercises in a limited space: The size and design of the structure or support is efficient, since it requires a minimum space for several users to perform exercises comfortably.

2. Easy-to-use gripping means and change of position with sliding capabilities: The gripping means of the structure of the present invention contain two handles, one pulley system and one counterweight, specially designed for a delicate and smooth movement, offering a comfortable way to unlock the safety system, pull the gripping means, and slide it, so as to change the gripping position by applying a simple force. Consequently, it offers efficient adaptability to the characteristics of both user and type of exercise.

3. Adequate for any type of exercise band or rope: Bands or ropes of different lengths can be used according to the exercise to be performed. The structure of the present invention allows using different bands or ropes in the same hook, since the diameter of the loop is large enough to anchor more than one rope or band, whether elastic or rigid. However, it only requires one hand or rope of any type available on the market to perform the exercises.

4. Tolerates more force: Some exercise machines currently available have restrictions in terms of the force their structure can tolerate; for example, with machines anchored to surfaces such as doors using nylon belts, in the event that the user exerts all the force that his/her weight is capable of generating against the machine, it may lead to disengagement from the machine or deformation of the nylon belt. The structure proposed in the present invention offers higher resistance to large forces applied, to the extent that its structure is modular and is rigidly supported on bases that allow for placing a wide range of anchorages, depending on the resistance desired and the mounting surface.

5. Increased rigidity: The structure or support is rigid to avoid unwanted movements while performing exercises. Such rigidity of the structure is achieved by using structural angle frames made of materials such as steel, which keeps the structure of the invention from becoming deformed after being subjected to external forces. The structure of the invention presents lateral stability, since it admits lateral forces to perform any kind of exercise with bands or ropes, without letting the band slide or overlap, which would have an impact on the user to the extent that it leads to losing control and alters the exercise routine, even resulting in spine problems.

6. Allows for a bird's eye movement of the hook (may be vertical, horizontal or diagonal): The gripping means contain a piece which allows for a bird's eye rotation of the hook, so that the band or rope is always in the same position in relation to the hook.

7. Easy performance of lower-body exercises: The structure makes it easier and safer to exercise muscles from the waist down, as it has one or more handrails. Handrails allow users to support themselves while performing exercises that so require. Handrail size is large enough for every user to grab onto them without bumping into each other.

8. Allows for adding a wide range of fittings and accessories: The structure of the invention is versatile, offering the possibility to add a range of accessories that may be coupled to the hook, as the loop diameter is wide enough to be used with any fitting or accessory currently available.

9. Adjustable to an adequate and sufficient height: The height of the structure or support is ideal for any person to perform a large number of exercises and may be adjusted to specific requirements of the average population.

10. The structure of this invention allows for easy adaptation to different surfaces or places: The structure of this invention incorporates in its design bases that keep enough distance from columns, so that protrusions of the surface will not affect it. Similarly, the structure of the present invention keeps the mounting surface free from significant damage or deterioration, since 4 orifices are enough to accommodate up to three users.

11. The structure can be installed at a certain distance from the floor (for instance, anchored to a wall) or at floor level, anchored to the floor.

12. The structure is adequate for all types of environments: Depending not only on the material but on the coating applied to such material, the structure or support will be suitable for installation in any kind of environment, whether humid or hot.

13. Simple assembly process: Any person with the instructions manual should be able to anchor and assemble the structure of the present invention as well as attach any accessory.

14. Maintenance: The structure of the present invention does not require constant maintenance because its elements, such as casters and bushing, are not subjected to friction, unlike equivalent elements in other machines. Furthermore, the elements of the present invention are manufactured using materials with self-lubricating characteristics, thus avoiding frequent maintenance by users of the modular structure for physical exercise of the present invention.

15. Reduced wear of hands or ropes: The structure of the present invention reduces the wear of exercise bands and ropes, as the currently available structures are supported for example by doors, banisters, etc. However, since those are not suitable supports that were designed to this end, such objects that serve as a support can get worn away or damaged, and even bands or ropes themselves can get damaged or worn away. The structure of the present invention contains a wear and tension absorber system incorporated into the gripping means which contains a swivel joint that allows the hook to move freely according to the direction of the band or rope, and the hook which does not let lateral sliding, also reduces wear.

16. Safety for equipment users: The structure of the present invention, provides additional safety elements to those offered in the prior art, including the easy locking system in which every sliding surface has a range of preset heights consisting of orifices where the protector plate screws fit and do not allow for involuntary changes of position.

17. The easy-to-use novel structure of the present invention allows its usage by people with physical, mental, sensorial or intellectual disabilities.

18. The hidden internal system prevents reproduction or undue manipulation of the structure.

Other embodiments of this invention that become apparent to those of expert skill in the art from reading and putting into practice the description of this invention are deemed included in the scope of protection of this invention. This descriptive specification and any examples mentioned herein are given for the purpose of illustration and not for the purpose of limiting the scope or spirit of the invention, which is defined by the following claims.

The invention claimed is:

1. A modular structure for physical exercise, the modular structure comprising:

an upper base of the modular structure which is a plate fixed to a sliding surface; the sliding surface is supported on a lower base of the modular structure which comprises a first plate of the lower base and a second plate of the lower base; the first and second plates of the lower base are fixed by means of lower base screws, lower base nuts, and lower base joints; and a gripping means with a hook configured to receive a resistance band, the gripping means sliding on the sliding surface, wherein the sliding surface comprises: a sliding surface rail accommodated in a sliding surface tube; a first wire rope coupled to a large lower pulley and a small lower pulley; and a second wire rope coupled to a large upper pulley and a small upper pulley; wherein the first and second wire ropes, the large lower and upper pulleys, and the small lower and upper pulleys allow for sliding movement of the sliding surface rail in the sliding surface tube; and a counterweight to equilibrate the modular structure and provide resistance.

2. The modular structure for physical exercise according to claim 1, wherein the upper base of the modular structure and the lower base of the modular structure have anchoring orifices.

3. The modular structure for physical exercise according to claim 1, wherein the sliding surface rail and the sliding surface tube are attached on opposing ends, respectively, to upper base joints and to the lower base joints.

4. The modular structure for physical exercise according to claim 1, wherein the sliding surface rail is a metal bar on which the gripping means slides along.

5. The modular structure for physical exercise according to claim 1, wherein the sliding surface tube is a metal tube that accommodates: the second wire rope; an upper hook or an upper snap hook; the counterweight; the small lower pulley; the first wire rope, and a lower nipple and wherein said sliding surface tube serves as an anchorage support for handrails and as structural reinforcement for the sliding surface rail.

6. The modular structure for physical exercise according to claim 5, wherein the large lower pulley is located on a large lower pulley screw with a lower bushing, a first end of the first wire rope goes through the large lower pulley then through the small lower pulley; wherein the lower nipple is located on the sliding surface tube, a second end of the first wire rope is placed on the lower nipple and secured with a lower square tube clip; wherein the large upper pulley is located on a large upper pulley screw with an upper bushing, a first end of the second wire rope goes through the large upper pulley then through the small upper pulley; wherein an upper nipple is located on the sliding surface tube, a second end of the first wire rope is placed on the upper nipple and fixed with an upper square tube clip; wherein an end of the small lower pulley attaches to a lower hook or a lower snap hook which attaches to a first end of the counterweight; and wherein an end of the small upper pulley attaches to the upper hook or the upper snap hook which attaches to a second end of the counterweight opposite the first end of the counterweight.

7. The modular structure for physical exercise according to claim 5, wherein the hook of the gripping means, a lower hook or a lower snap hook, and the upper hook or the upper snap hook are each comprised of two parts: a first unit made of an elongated material, the first unit having two ends and being bent such that the two ends face each other and are spaced apart from each other; and a second unit made of the elongated material, the second unit being fixed at a first end thereof to a first end of the two ends of the first unit such that a second end of the second unit can be pulled closer to or farther from a second end of the two ends of the first unit.

8. The modular structure for physical exercise according to claim 5, wherein the counterweight is a cylinder having a height and a base, the height being larger than a radius of the base, a first end of the counterweight having a first ring coupled lower hook or a lower snap hook for coupling to the first wire rope, and a second end of the counterweight having a second ring coupled to the upper hook or the upper snap hook for coupling to the second wire rope.

9. The modular structure for physical exercise according to claim 1, wherein there are one, two or three sliding surfaces in the modular structure, and the modular structure can have handrails which respectively attach to each sliding surface using handrail joints, a handrail screw, and a handrail nut.

10. A modular structure for physical exercise, the modular structure comprising:

an upper base of the modular structure which is a plate fixed to a sliding surface; the sliding surface is supported on a lower base of the modular structure which comprises a first plate of the lower base and a second plate of the lower base; the first and second plates of the lower base are fixed by means of lower base screws, lower base nuts, and lower base joints; and a gripping means which slides on the sliding surface, wherein the gripping means comprises: a disk; a swivel joint mounted to the disk, a hook mounted to the swivel joint, a caster placed within a rail of the sliding surface; a main spring and a swivel joint screw.

11. The modular structure for physical exercise according to claim 10, wherein the gripping means further comprises two protector plate handles, a pulley system, and a counterweight.

12. The modular structure for physical exercise according to claim 10, wherein the swivel joint has a large opening and a small opening at respective opposing ends of the swivel joint.

13. The modular structure for physical exercise according to claim 10, wherein the disk is a circular shaped piece with an orifice in a center thereof, wherein a screw is fixed by means of a nut.

14. The modular structure for physical exercise according to claim 10, wherein the main spring is located between a spring and the caster, and the main spring is attached to a first wire rope and to a second wire rope using upper rail clips and lower rail clips.

15. The modular structure for physical exercise according to claim 10, wherein the swivel joint screw passes through: the main spring; the caster; a protector plate; a spring; the disk; a disk nut; and a large opening of the swivel joint.

16. A modular structure for physical exercise, the modular structure comprising:

an upper base of the modular structure which is a plate fixed to a sliding surface; the sliding surface is supported on a lower base of the modular structure which comprises a first plate of the lower base and a second plate of the lower base; the first and second plates of the lower base are fixed by means of lower base screws, lower base nuts, and lower base joints; and a gripping means which slides on the sliding surface, the gripping means comprising: a hook; a swivel joint; a disk; a caster; a main spring; a swivel joint screw; a spring; and a protector plate.

17. The modular structure for physical exercise according to claim 16, wherein the spring slides along the swivel joint screw such that the spring is positioned between the disk and the protector plate.

18. The modular structure for physical exercise according to claim 16, wherein the protector plate comprises: two handles that allow for an easy-to-use safety system to slide the gripping means by compressing the spring toward a direction of a user; four additional casters of the protector plate that allow the sliding, surface to slide smoothly along a rail; and a rubber foam that attaches to the protector plate.

* * * * *